US010738405B2

(12) United States Patent
Kim et al.

(10) Patent No.: US 10,738,405 B2
(45) Date of Patent: Aug. 11, 2020

(54) WASHING MACHINE

(71) Applicant: Samsung Electronics Co., Ltd., Suwon-si (KR)

(72) Inventors: Young-jae Kim, Seoul (KR); Sam-young Jang, Yongin-si (KR); Myung-won Jeon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 114 days.

(21) Appl. No.: 15/459,995

(22) Filed: Mar. 15, 2017

(65) Prior Publication Data

US 2017/0275803 A1 Sep. 28, 2017

(30) Foreign Application Priority Data

Mar. 25, 2016 (KR) ..... 10-2016-0036061

(51) Int. Cl.

| | |
|---|---|
| ***D06F 39/00*** | (2020.01) |
| ***D06F 39/02*** | (2006.01) |
| ***D06F 33/02*** | (2006.01) |
| ***D06F 39/14*** | (2006.01) |
| ***D06F 34/28*** | (2020.01) |
| ***D06F 33/00*** | (2020.01) |
| *D06F 39/12* | (2006.01) |

(52) U.S. Cl.

CPC ..... *D06F 34/28* (2020.02); *D06F 33/00* (2013.01); *D06F 39/02* (2013.01); *D06F 39/14* (2013.01); *D06F 39/12* (2013.01)

(58) Field of Classification Search

CPC ..... D06F 33/02; D06F 39/005; D06F 39/14; D06F 39/02; D06F 39/12; D06F 33/00; D06F 34/28

See application file for complete search history.

(56) References Cited

U.S. PATENT DOCUMENTS

| | | | | |
|---|---|---|---|---|
| 8,956,579 | B2 * | 2/2015 | Yankee | D06F 39/022 422/501 |
| 2003/0178894 | A1 * | 9/2003 | Ghent | D06F 33/02 307/140 |
| 2008/0125911 | A1 * | 5/2008 | Ebrom | G06F 9/54 700/275 |
| 2008/0134728 | A1 * | 6/2008 | Son | A47L 15/4257 68/212 |

(Continued)

FOREIGN PATENT DOCUMENTS

| | | | |
|---|---|---|---|
| KR | 10-2007-0002243 | A | 1/2007 |
| KR | 10-2007-0002246 | A | 1/2007 |

*Primary Examiner* — Benjamin L Osterhout

(57) ABSTRACT

A washing machine including a module housing that can accommodate a communication module is provided, which includes a front panel on which an inlet port for putting laundry there through is formed, and a control panel arranged on an upper portion of the front panel, wherein the control panel includes a first opening provided thereon to arrange an operation portion for operating the washing machine therein, a circuit board mounted thereon to receive a signal that is input from the operation portion, and a module housing mounted thereon and having an accommodation space for accommodating at least a part of a communication module for the washing machine to communicate with an external device.

13 Claims, 14 Drawing Sheets

(56) References Cited

U.S. PATENT DOCUMENTS

| | | | | |
|---|---|---|---|---|
| 2009/0090137 | A1* | 4/2009 | Jeong | D06F 33/02 68/12.02 |
| 2011/0061176 | A1* | 3/2011 | Kappler | D06F 33/02 8/137 |
| 2011/0264245 | A1* | 10/2011 | Lim | H04L 12/12 700/90 |
| 2011/0276289 | A1* | 11/2011 | Park | G01D 4/00 702/62 |
| 2013/0204448 | A1* | 8/2013 | Lee | G01D 4/004 700/291 |
| 2016/0177485 | A1* | 6/2016 | Fueglein | D06F 23/02 8/137 |

* cited by examiner

WASHING MACHINE

CROSS-REFERENCE TO RELATED APPLICATION(S) AND CLAIM OF PRIORITY

This application claims priority from Korean Patent Application No. 10-2016-0036061 filed on Mar. 25, 2016 in the Korean Intellectual Property Office, the disclosure of which is incorporated herein by reference in its entirety.

BACKGROUND

1. Field of the Invention

The present disclosure relates to a washing machine including a module housing that can accommodate therein at least a part of a communication module.

2. Description of the Related Art

In general, a washing machine is a device that includes a tub provided to contain wash water therein and a drum rotatably installed in the tub. The washing machine performs washing of laundry that is contained in the drum through rotation of the drum within the tub.

The washing machine as configured above performs a washing stroke for washing laundry, a rinsing stroke for rinsing the washed laundry, and a dehydration stroke for dehydrating the wet laundry.

However, the washing machine has the drawback that a user should select washing targets one by one whenever washing is performed, and should input washing operation information through user's direct manipulation of an input portion every time.

SUMMARY OF THE INVENTION

Exemplary embodiments of the present disclosure overcome the above disadvantages and other disadvantages not described above, and provide a washing machine including a module housing that can accommodate therein at least a part of a communication module.

Further, exemplary embodiments of the present disclosure provide a washing machine, which can enable a communication module to be easily attached to or detached from a module housing, and can save the manufacturing cost.

According to an aspect of the present disclosure, a washing machine includes a front panel on which an inlet port for putting laundry there through is formed; and a control panel arranged on an upper portion of the front panel, wherein the control panel includes a first opening provided thereon to arrange an operation portion for operating the washing machine therein, a circuit board mounted thereon to receive a signal that is input from the operation portion, and a module housing mounted thereon and having an accommodation space for accommodating at least a part of a communication module for the washing machine to communicate with an external device.

According to another aspect of the present disclosure, a washing machine includes a front panel on which an inlet port for putting laundry there through is formed; a control panel arranged on an upper portion of the front panel; and an upper panel, wherein the control panel includes a front surface portion provided with a first opening in which an operation portion for operating the washing machine is arranged; an upper surface portion extending backward from the front surface portion to be connected to the upper panel; an accommodation space for accommodating at least a part of a communication module for the washing machine to communicate with an external device; and a second opening provided on the upper surface portion to enter into the accommodation space.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Figure 1:
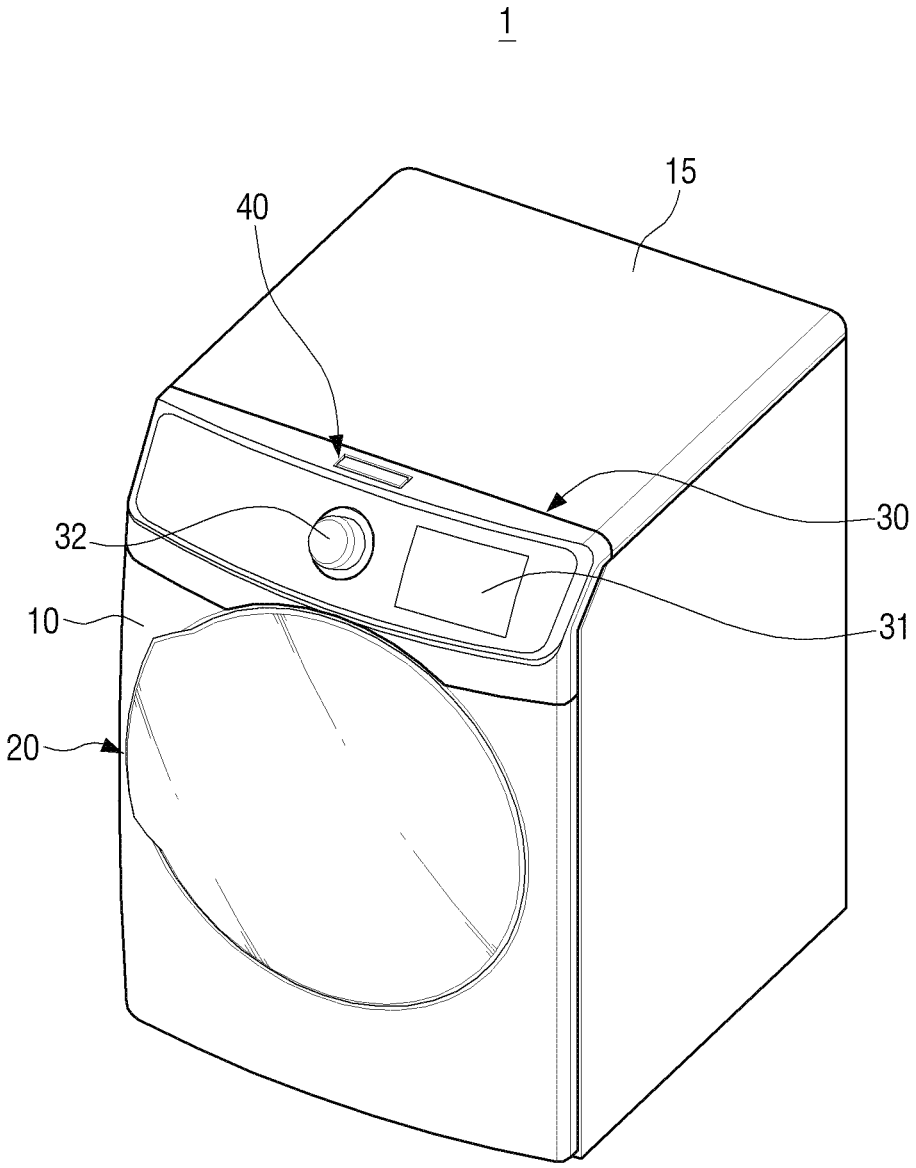
FIG. 1 is a perspective view illustrating an external appearance of a washing machine according to an embodiment of the present disclosure.
Figure 2:
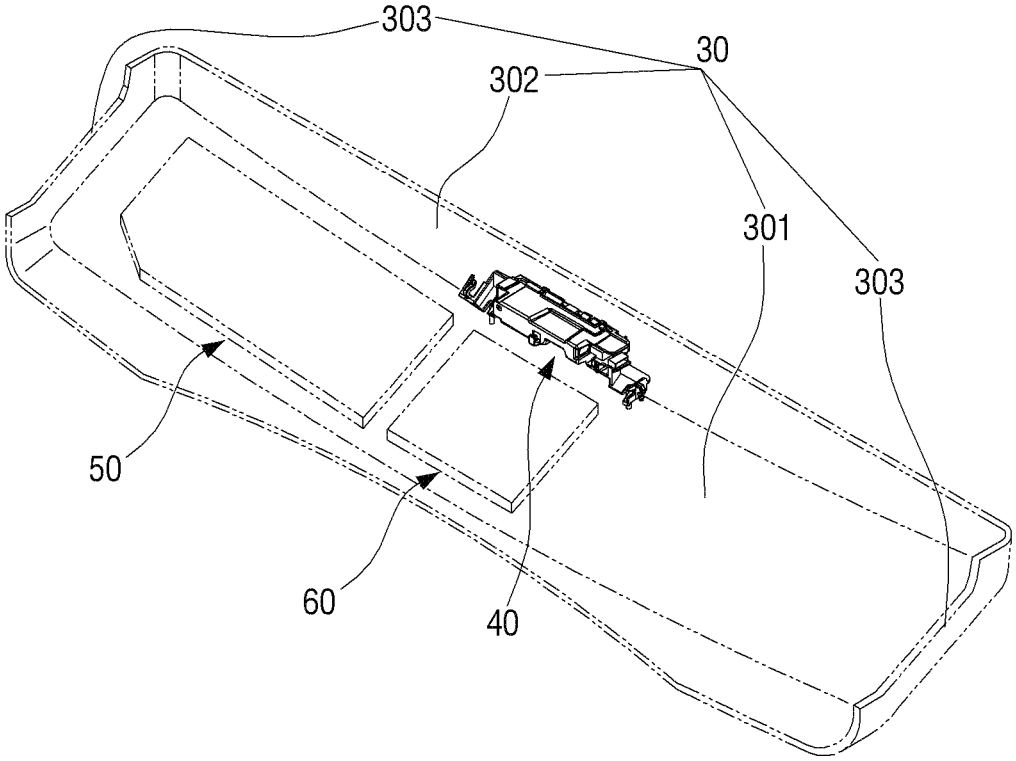
FIG. 2 is a perspective view illustrating a control panel according to an embodiment of the present disclosure.

Hereinafter, exemplary embodiments of the present disclosure will be described in detail with reference to accompanying FIGS. 1 to 14. The following description with reference to the accompanying drawings is provided to assist in a comprehensive understanding of the technical features of the present disclosure. However, the technical features of the present disclosure are not Limited by the embodiments, but it is exemplified that the present disclosure may be implemented by the specific embodiments to be described hereinafter.

Accordingly, those of ordinary skill in the art will recognize that various changes and modifications of the various embodiments described herein can be made without departing from the scope and spirit of the present disclosure. In addition, like drawing reference numerals are used for the like elements, even in different drawings. Also, well-known functions or constructions are not described in detail since they would obscure the application with unnecessary detail.

A terminal according to an embodiment to be described hereinafter may be a device that includes a communication function. For example, the terminal may include at least one of a smart phone, tablet PC (Personal Computer), mobile phone, video phone, e-book reader, desktop PC (Personal Computer), net-book computer, PDA (Personal Digital Assistant), PMP (Portable Multimedia Player), MP3 player, mobile medical device, camera, and wearable device (e.g., HMD (Head-Mounted Device) such as electronic glasses, electronic clothes, electronic bracelet, electronic necklace, electronic appcessory, electronic tattoo, or smart watch).

Further, although a washing machine is exemplified as a home appliance according to an embodiment to be described hereinafter, the home appliance may be a smart home appliance having a communication function. The smart home appliance may be applied to, for example, a television receiver, DVD (Digital Video Disk) player, audio, refrigerator, air conditioner, cleaner, oven, microwave oven, washing machine, drier, air purifier, set-top box, TV box, game consoles, electronic dictionary, electronic key, camcorder, or digital photo frame.

FIG. 1 is a perspective view illustrating an external appearance of a washing machine according to an embodiment of the present disclosure. Referring to FIG. 1, a washing machine 1 may include a front panel 10 on which an inlet port for putting laundry therethrough is formed, and a control panel 30 arranged on an upper portion of the front panel 10.

On a front surface of a washing tub, an inlet port may be formed to put laundry into a rotary tub through the inlet port, and the inlet port may be opened or closed by a door 20 that is installed on a front surface portion of the front panel 10. Further, on an inside of the door 20, door glass that is formed of a transparent material may be mounted so that a user can check an interior state of the rotary tub with the naked eye.

On an upper portion of the washing tub, a detergent supply device for supplying wash water that is mixed with a detergent into the washing tub may be installed. The detergent supply device may include a detergent container which accommodates the detergent and is movable in forward/backward direction. Further, on a lower portion of the washing tub, a drain pump and a drain pipe for discharging water that is in the washing tub out of a main body of the washing machine may be installed.

The control panel 30 may form corners of front and upper surface portions of the front panel 10 and an upper panel 15. The control panel 30 may be mounted on the front panel 10 after being separately prepared. As an example, the control panel 30 may be made of a material, such as PC (Poly Carbonate) or ABS (Acrylonitrile Butadiene Styrene), through an injection method.

The operation of the washing machine 1 may include a washing stroke, a rinsing stroke, and a dehydration stroke. A user may subdivide and select the washing stroke in accordance with the kind of laundry and the pollution degree of laundry. Further, the operation state of the washing machine 1 is displayed to the user. On the control panel 30, an opening may be formed to provide a display portion 31 for displaying the operation state of the washing machine 1 and user's manipulation state thereof.

Further, on the control panel 30, various kinds of buttons (not illustrated) for receiving an input of a user command to control the operation of the washing machine 1 and a jog dial 32 for selecting a washing course may be provided.

Further, the washing machine may include a module housing 40. The module housing 40 may be provided on an inside of an upper portion of the control panel 30, and may have an accommodation space 40A (in FIG. 3) for accommodating a module (or a communication module) therein. The details of the module housing 40 will be described with reference to the accompanying drawings.

Although not illustrated, a cover plate (not illustrated) may be additionally attached to the front surface of the control panel 30. The cover plate may be shaped to correspond to the control panel 30, and may be fastened to come in close contact with the control panel 30 so as to cover the front surface of the control panel 30.

As described above, the control panel 30 is provided on the upper portion of the front panel 10. The control panel 30 may include a front plate 301 located on a front surface portion of a main body, an upper plate 302 connected to an upper portion of the front plate 301 and located on the upper surface of the front panel 10, and side plates 303 connected between the front plate 301 and the upper plate 302 and located on side surfaces of the front panel 10.

As an example, the module housing 40 may be mounted on the upper plate 302. The module housing 40 may be fixed to the upper plate 302 through a separate fastening means. The module housing 40 may have an open upper portion, and the upper plate 302 may be connected to the module housing 40 so that the open upper portion of the module housing 40 communicates with an outside through a communication hole (not illustrated) that corresponds to the open upper portion of the module housing 40.

In the case where the module housing 40 is mounted on the upper plate 302, a user can secure a comfortable viewing angle, and can mount the module on the module housing 40 on a comfortable moving line. Further, the user can efficiently use an inner space of the control panel 30 through mounting of the module housing 40 on the control panel 30. Further, in the case where a detergent supply device is installed on one side of the washing machine 1 to supply a detergent into the washing machine 1, the module housing 40 may be eccentrically located in the center portion or on one side of the upper plate 302. However, the installation location of the module housing 40 is not limited thereto.

Figure 3:
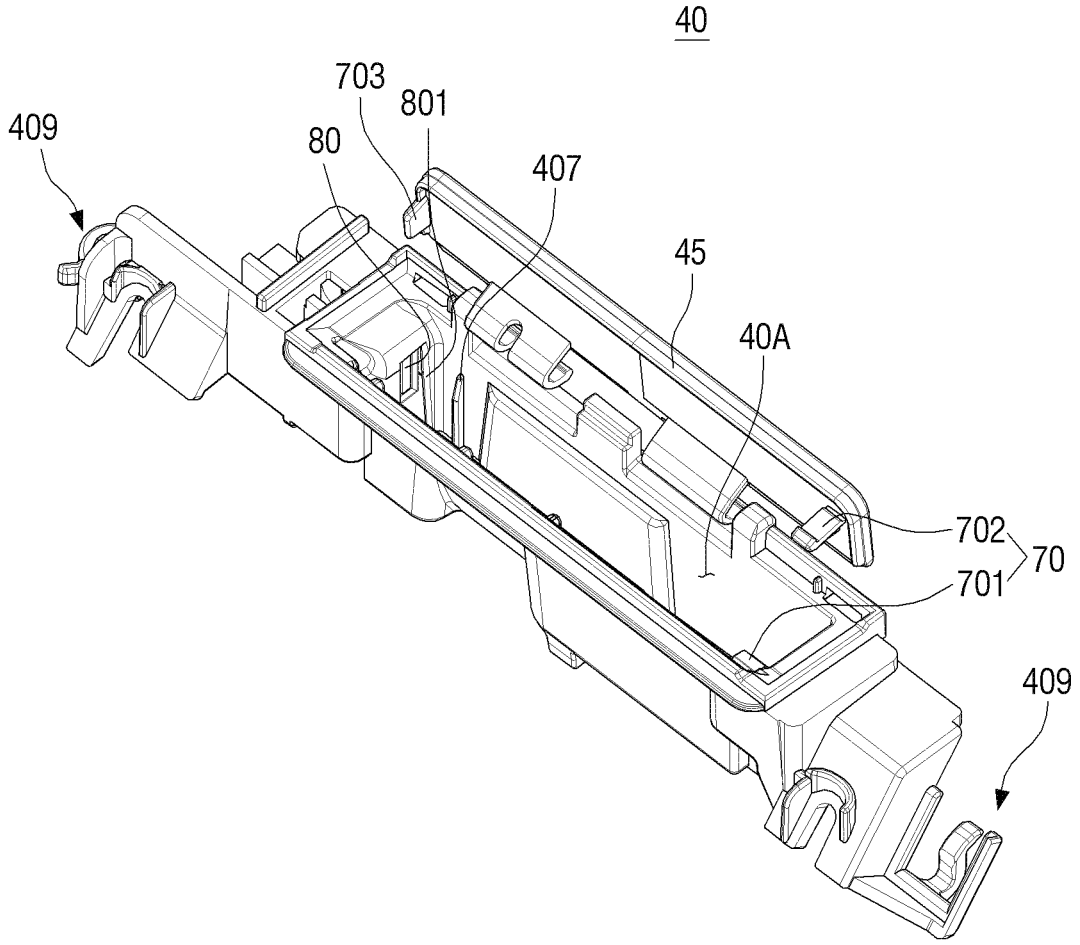
FIG. 3 is a perspective view illustrating a module housing according to an embodiment of the present disclosure.
Figure 4:
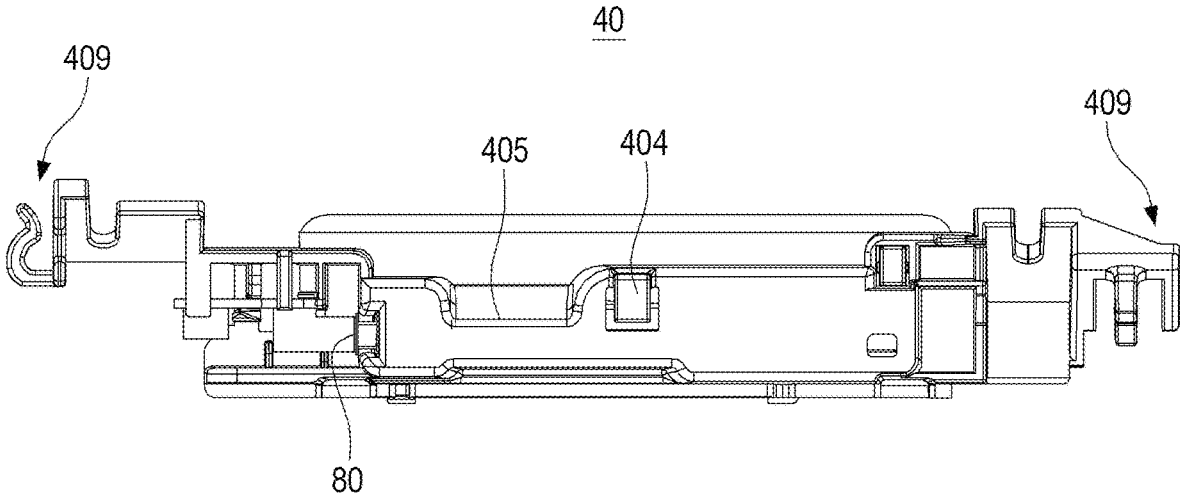
FIG. 4 is a bottom view illustrating a module housing according to an embodiment of the present disclosure.
Figure 5:
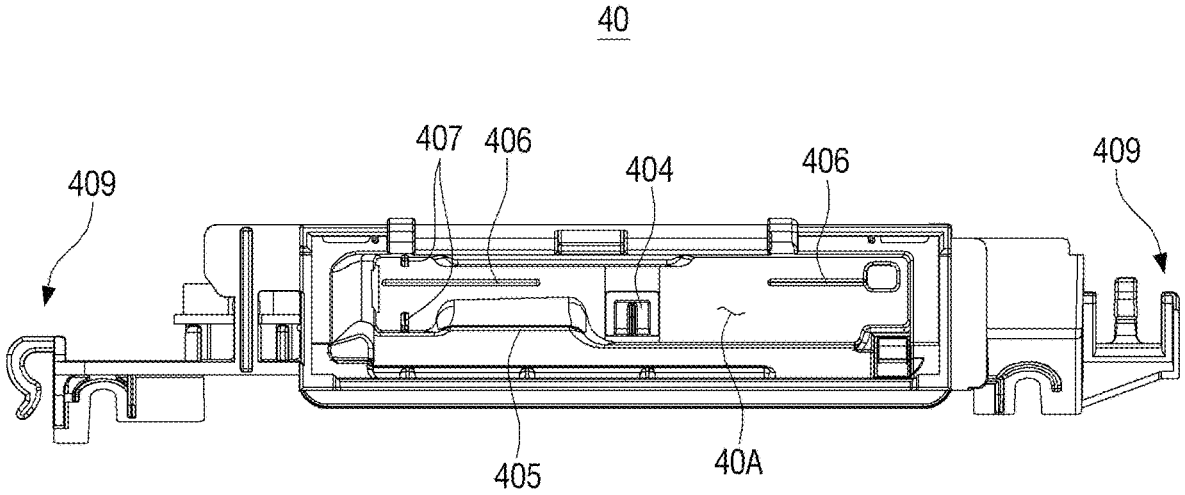
FIG. 5 is a plan view illustrating a module housing according to an embodiment of the present disclosure.
Figure 6:
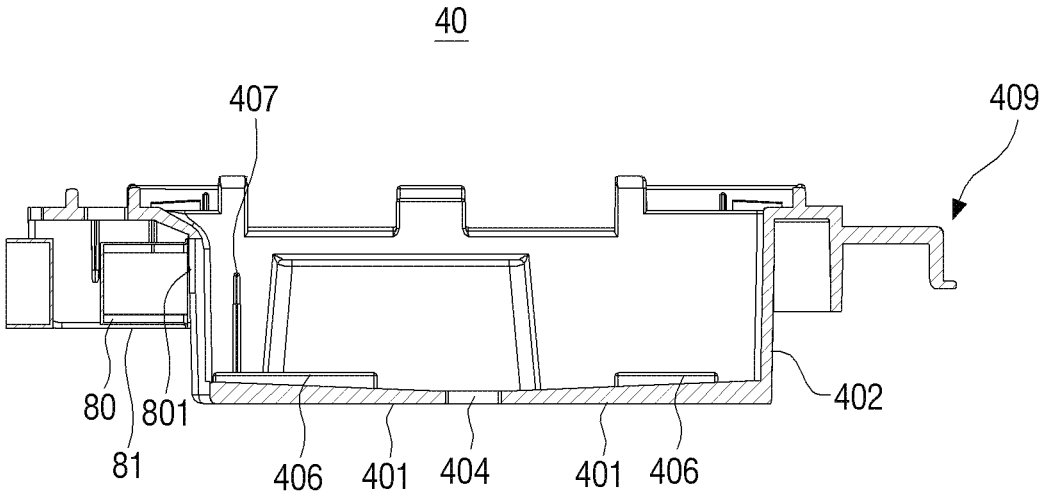
FIG. 6 is a cross-sectional view illustrating a module housing according to an embodiment of the present disclosure.
Figure 7:
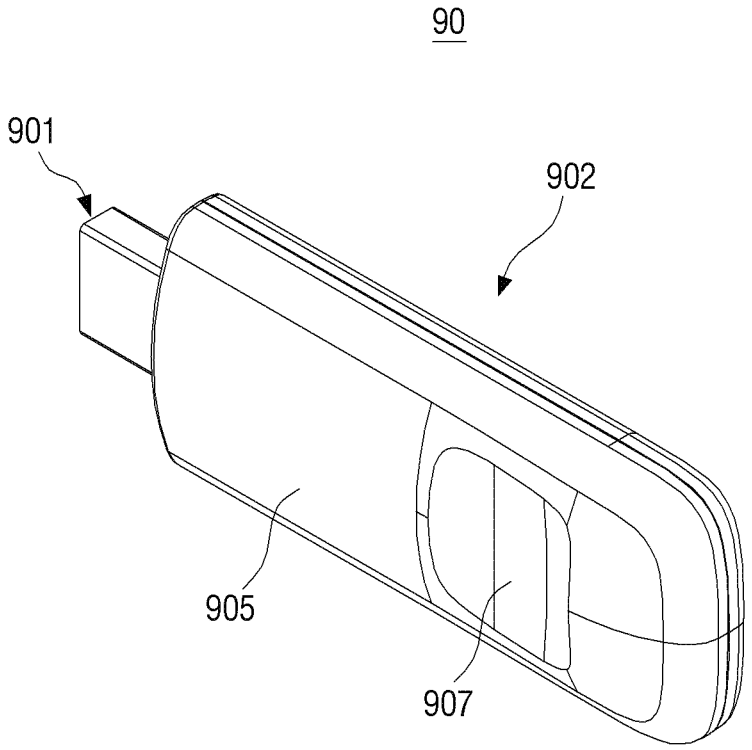
FIG. 7 is a perspective view illustrating a communication module according to an embodiment of the present disclosure.
Figure 8:
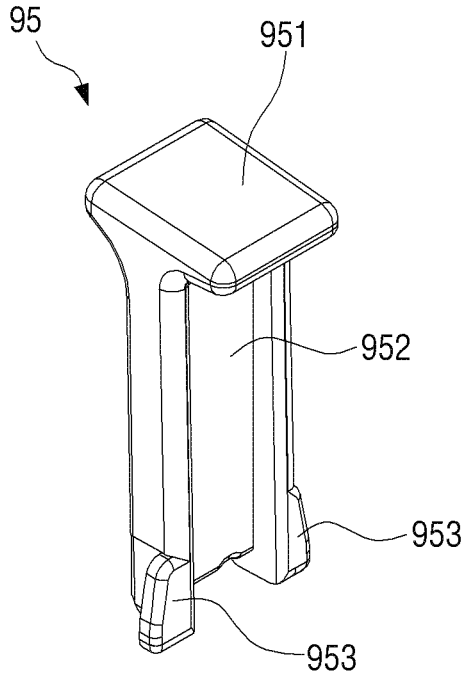
FIG. 8 is a perspective view illustrating a blocking member according to an embodiment of the present disclosure.

FIG. 3 is a perspective view illustrating a module housing according to an embodiment of the present disclosure, and FIG. 4 is a bottom view illustrating a module housing according to an embodiment of the present disclosure. Further, FIG. 5 is a plan view illustrating a module housing according to an embodiment of the present disclosure, and FIG. 6 is a cross-sectional view illustrating a module housing according to an embodiment of the present disclosure. Further, FIG. 7 is a perspective view illustrating a communication module according to an embodiment of the present disclosure, and FIG. 8 is a perspective view illustrating a blocking member according to an embodiment of the present disclosure.

Referring to FIGS. 3 to 8, the module housing 40 may have an open upper portion, and a cover 45 may open or close the open upper portion of the module housing 40. As an example, the cover 45 may be hinge-engaged with the module housing 40 to open or close the open upper portion of the module housing 40.

A support bar 703 may be formed to project from a bottom surface of the cover 45, and may be located on an opposite side of a locking bar 702. In the case where the locking bar 702 is locked in a latch 701, the support bar 703 may be seated on an inner wall of the module housing 40 to stably support the cover 45.

Although not illustrated, a sealing member may be interposed between the module housing 40 and the cover 45 to keep the module housing 40 and the cover 45 airtight.

On one side portion of the module housing 40, a communication port (or connection portion) 80 which is electrically connected to a module (communication module) 90 that is inserted into the module housing 40 may be provided. As an example, a connection hole 801 may be formed on one side portion of the module housing 40, and the communication port 80 may be fixedly installed on an outside of the accommodation space 40A to approach the connection hole 801. As an example, the module housing 40 may be provided with a communication port fixing portion 81 for fixing the communication port 80.

The communication module 80 may include a terminal portion 901 that is inserted into the connection hole 801 and is electrically connected to the communication port 80, and a body portion 902 that is connected to the terminal portion 901 and is accommodated in the accommodation space 40A. The terminal portion 901 may be formed to project from the body portion 902, and may serve as a path for supplying an electronic signal to the body portion 902.

In the case where the terminal portion 901 is connected to the communication port 80, it may serve as a communication interface for performing communication with a terminal (not illustrated). That is, it is possible to perform wireless transmission/reception with the washing machine 1 through the terminal. In addition to the role of the communication interface, the communication module 90 may serve to be provided with an update of a program that is related to a new washing course or a performance test of the washing machine.

The communication interface as described above may wirelessly transmit/receive data with the terminal through a wireless network, such as a ZigBee communication network, WiFi communication network, Bluetooth communication network, or a mobile communication network. In addition, the terminal is a device that checks and manages information on the operation state (e.g., washing process, such as washing function start, addition, end, and notification) of the washing machine 1. The terminal can be connected to a network, and includes all devices (e.g., communication terminal and smart phone) having display devices. In addition, the terminal may check and manage the status information of the washing machine using a dedicated application.

A bottom surface 401 may be located to be downwardly inclined toward a drain hole 404. Accordingly, if water, wet stream, or foreign substance flows into the accommodation space 40A, it may be discharged to an outside through the drain hole 404. In addition to the drain hole 404, a plurality of holes may be separately provided on the bottom surface 401.

The accommodation space 40A may have a cross-sectional area that is larger than that of the communication module 90 so as to accommodate the communication module 90 therein. As an example, the accommodation space 40A may be formed to have a length direction that is greater than that of the communication module 90 so that the communication module 90 can move toward the connection portion 80.

Further, the accommodation space 40A may have a width direction that is vertical to the length direction so as to accommodate the communication module 90 therein, and one side portion thereof that is adjacent to the communication port 80 may have a width that is smaller than the width of the other side portion (opposite side to the connection portion). Since the other side portion of the accommodation space 40A has the width that is larger than the width of the one side portion thereof, a user can easily insert the communication module 90 into the module housing 40. In addition, the user may move the communication module 90 to slide toward the communication port 80 through insertion of a user's finger into the module housing 40.

As an example, a guide portion 405 may be formed on the inner wall of the module housing 40. The guide portion 405 may be provided to project along the length direction of the communication module 90, and may be eccentrically arranged to be adjacent to the communication port 80.

The body portion 902 of the communication module 90 may have a convex surface 905 that faces the guide portion 405. That is, the guide portion 405 may provide a width that corresponds to the thickness of the body portion 902. In addition, in the case where the user turns the communication module 90 reversely and inserts the communication module 90 into the module housing 40, the body portion 902 is not inserted into the accommodation space 40A due to the inconsistency of the convex surface 905 of the communication module 90 with the guide portion 405, and thus the user can effectively insert the communication module 90 into the module housing 40. The body portion 902 may be provided with a concave surface 907 that is formed recessed from the convex surface 905 to facilitate the user's grasping.

Further, the guide portion 405 may be shaped to have an increasing cross-sectional area along the depth direction of the module housing 40. Accordingly, through the user's simple operation to drop the communication module 90 into the accommodation space 40A, the communication module 90 is guided by the guide portion 405 to be inserted into the module housing 40. In accordance with the thickness or the shape of the communication module 90, a separate projection may be additionally provided on an opposite surface of the guide portion 405 to adjust the width of the accommodation space 40A.

On the bottom surface 401, a guide rib 406 may be formed to project toward the upper portion. The guide rib 406 may be formed in parallel to the length direction of the communication module 90, and an upper end of the guide rib 406 may be located at the same height. The communication module 90 is supported by an upper surface of the guide rib 406 to be spaced apart for a predetermined distance from the bottom surface 401. Accordingly, the module can be protected against water or other pollution sources in the accommodation space 40A. In addition, a plurality of guide ribs 406 may be provided on the same line to be spaced apart from each other for a predetermined distance, and thus the communication module 90 can be aligned from the inclined bottom surface 401.

A support rib 407 may be formed inside the module housing 40. The support rib 407 may be located along the depth direction of the accommodation space 40A to support a blocking member 95. Support ribs 407 may be located in order on the side surface to face each other. The blocking member 95 may be provided with a grip portion 951 formed on the upper portion thereof.

The blocking member 95 may include a support bar 952 that is shaped to increase the cross-sectional area along the depth direction of the support rib 407 in order to facilitate attachment or detachment thereof to or from the module housing 40 and to maintain a stable fixed state to the support rib 407. On lower end portions of the support bar 952, cover portions 953 that are formed to project from the support bar 952 toward the width direction may be provided. In the case where the blocking member 95 is mounted on the module housing 40, water that has flowed into the accommodation space 40A through the cover portion 953 can be doubly protected from flowing toward the communication port 80.

Further, the module housing 40 may further include a wire support portion 409 connected to both sides of the module housing 40. Coupling projections 409 are to fix wires (not illustrated) for transferring a signal from the communication port 80 to circuit boards 50 and 60. Hereinafter, a process of mounting the communication module 90 on the module housing 40 will be described.

Figure 9:
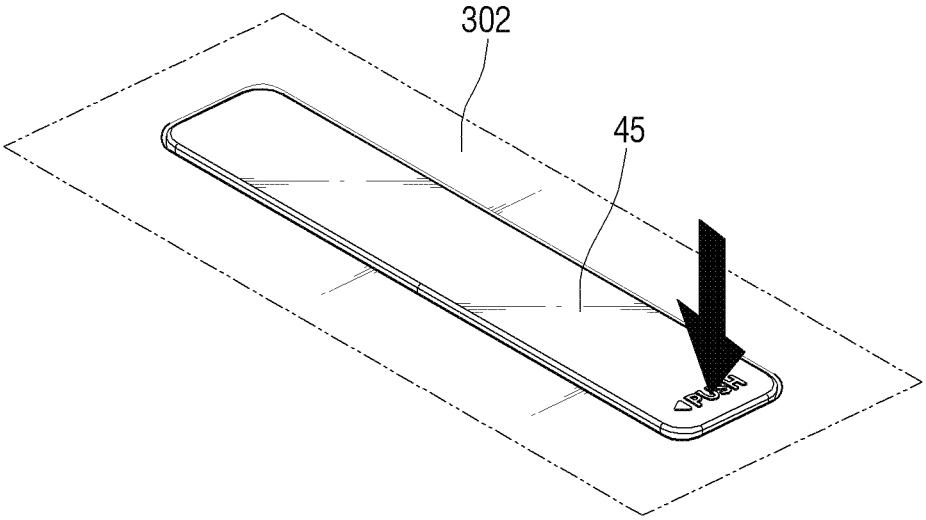
FIGS. 9 to 14 are explanatory views illustrating an operation process of a module housing according to an embodiment of the present disclosure.
Figure 10:
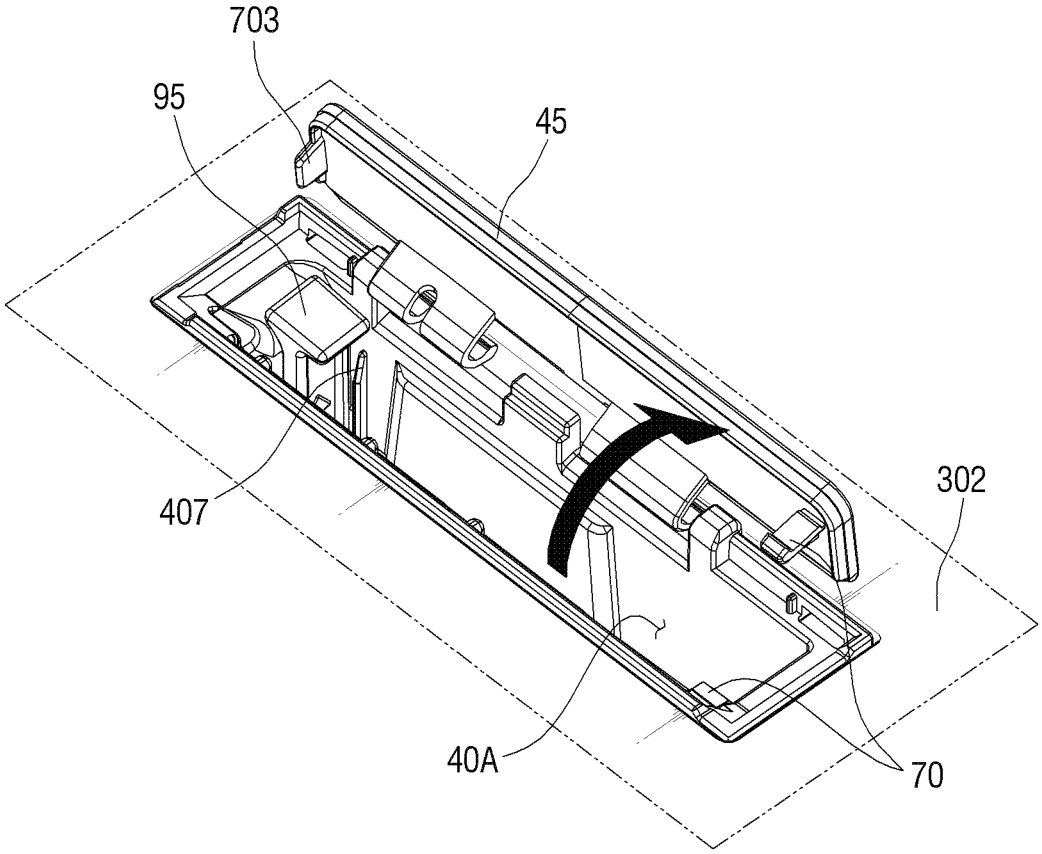
Figure 11:
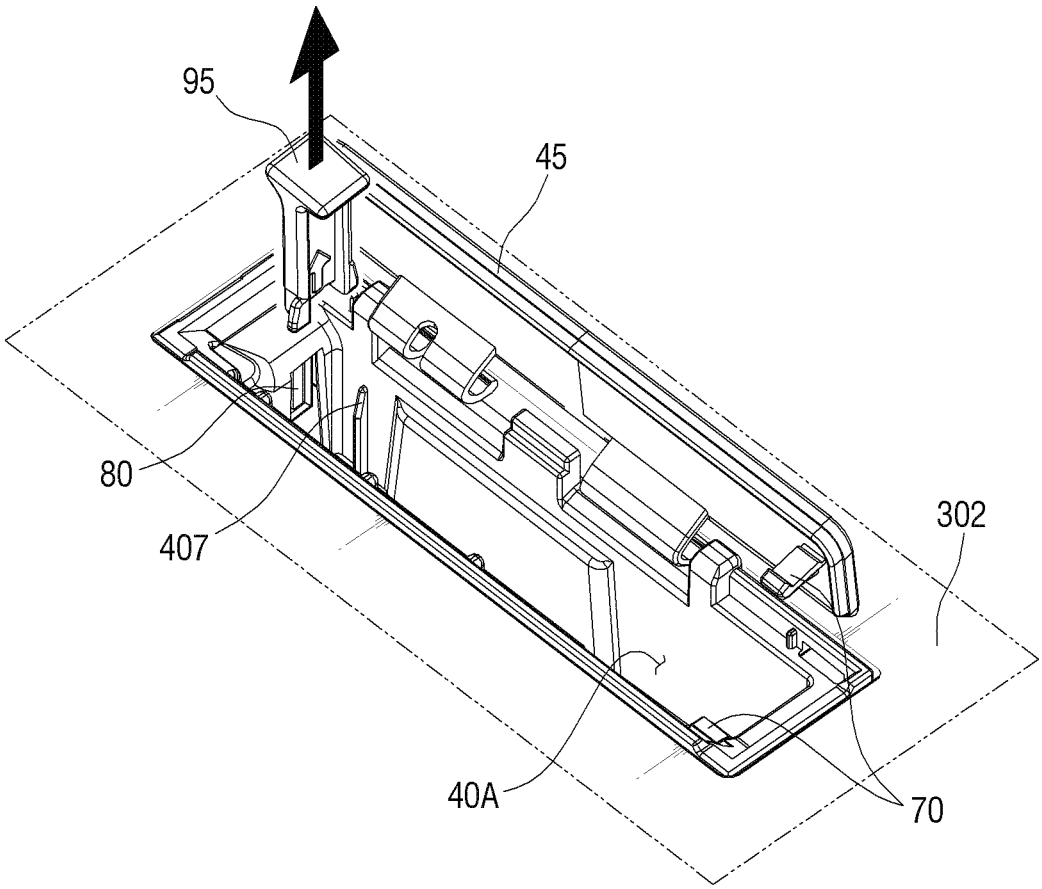

FIGS. 9 to 14 are explanatory views illustrating an operation process of a module housing according to an embodiment of the present disclosure. Referring to FIGS. 9 to 11, a user can release a locking member 70 through pushing of the upper surface of the cover 45. Next, the user may open the upper portion of the module housing 40 through rotation of the cover 45 that is hinge-engaged with the module housing 40 around a hinge shaft.

Figure 12:
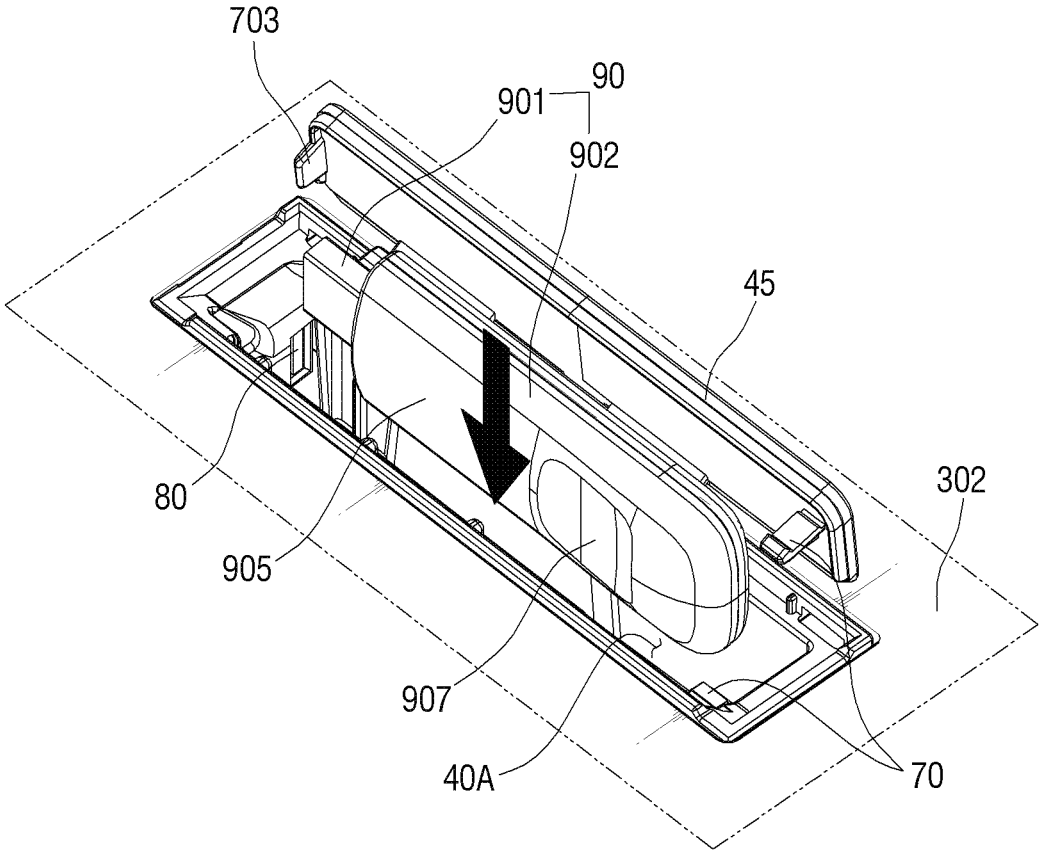
Figure 13:
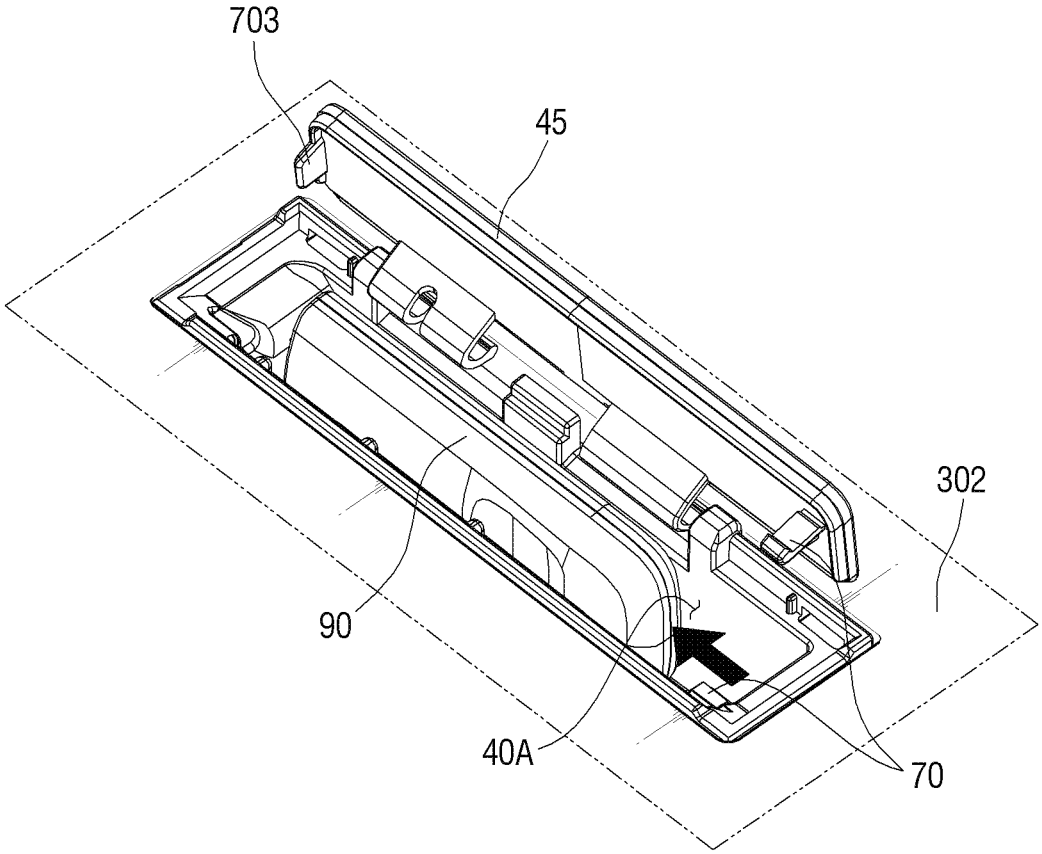
Figure 14:
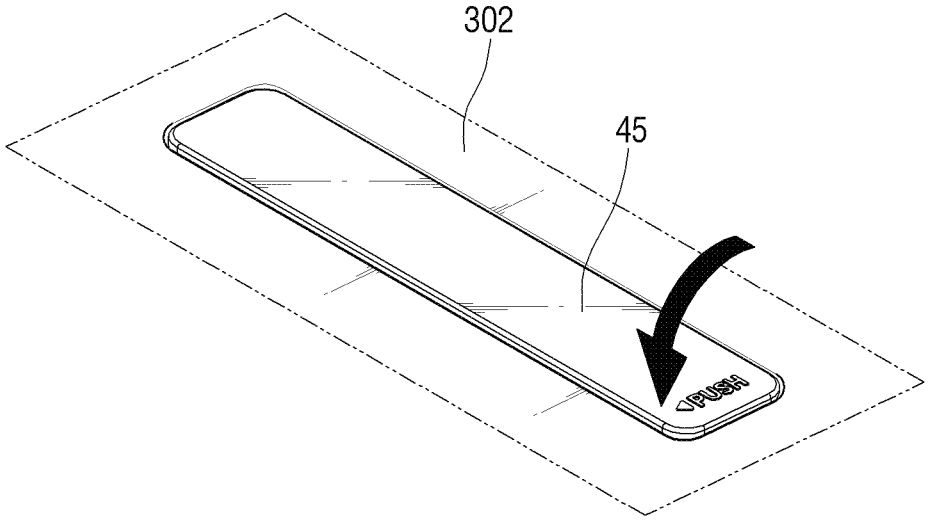

Referring to FIGS. 12 to 14, the user makes the blocking member 95 secede from the accommodation space 40A, and then inserts the communication module 90 into the accommodation space 40A. As described above, the guide portion 405 is formed on the inner wall of the module housing 40, and the guide portion 405 may be provided to project along the length direction of the communication module 90.

Further, since the body portion 902 of the communication module 90 has the convex surface 905 that faces the guide portion 405, the user can prevent an unnecessary action for inserting the communication module 90 into the accommodation space 40A.

In addition, one side portion of the accommodation space 40A that is adjacent to the communication port 80 has the width that is smaller than the width of the other side portion (opposite side to the connection portion). The user may connect the terminal portion 901 and the communication port 80 to each other by making the communication module 90 easily slide toward the communication port 80 through insertion of the user's finger into the accommodation space 40A. Next, the user may close the open upper portion of the module housing 40 by rotating the cover 45 around the hinge shaft and fastening the cover 45 to the locking member 70 through pushing of the upper surface of the cover 45.

Each of the above-described constituent elements of the electronic device according to an embodiment of the present disclosure may be configured by one or more components, and the name of the corresponding constituent element may differ depending on the kind of the electronic device. The electronic device according to the present disclosure may be configured to include at least one of the above-described constituent elements, and may omit some constituent elements or may further include other additional constituent elements. Further, by combining some constituent elements of the electronic device according to the present disclosure to form one entity, functions of the corresponding constituent elements before being combined can be performed in the same manner.

In an embodiment of the present disclosure, the term "module" may mean, for example, a unit that includes one or two or more combinations of hardware, software, and firmware. The "module" may be interchangeably used with the term "unit, logic, logical block, component, or circuit". The "module" may be the minimum unit or a part of components that are configured in a body. The "module" may be a minimum unit or a part thereof that performs one or more functions. The "module" may be mechanically or electronically implemented.

At least a part of a device (e.g., modules or their functions) or a method (e.g., operations) according to an embodiment of the present disclosure may be implemented by instructions that are stored in a computer-readable storage media in the form of programming modules. In the case where the instructions are executed by one or more processors, the one or more processors can perform functions corresponding to the instructions. At least a part of the programming modules may include, for example, modules, programs, routines, sets of instructions, or processes, for performing one or more functions.

The computer-readable storage media may include magnetic media, such as hard disks, floppy discs, or magnetic tapes, optical media, such as CD-ROM (Compact Disc Read Only Memory) or DVD (Digital Versatile Disc), magneto-optical media, such as floptical disks, and hardware devices specially configured to store and execute program instructions, such as ROM (Read Only Memory), RAM (Random Access Memory), or flash memories. Further, the program instructions may include not only machine codes that are made by compilers but also high-class language codes that can be executed by computers using interpreters. The above-described hardware devices may be configured to operate as one or more software modules and vice versa, in order to perform the operations according to the present disclosure.

The modules or programming modules according to the present disclosure may include at least one of the above-described constituent elements, may omit parts thereof, or may further include other additional constituent elements. The operations that are performed by the module, programming modules, or other constituent elements according to the present disclosure may be executed in a sequential, parallel, repetitive, or heuristic method. Further, some operations may be executed in a different order or may be omitted, or other operations may be added.

Although the various embodiments of the present disclosure have been individually described, it is not necessary to solely implement the respective embodiments, but the configurations and operations of the respective embodiments may be implemented in combination with at least one of other embodiments.

The foregoing exemplary embodiments and advantages are merely exemplary and are not to be construed as limiting the present disclosure. The present teaching can be readily applied to other types of apparatuses. Also, the description of the exemplary embodiments of the present disclosure is intended to be illustrative, and not to limit the scope of the claims, and many alternatives, modifications, and variations will be apparent to those skilled in the art.

What is claimed is:

1. A washing machine comprising:

a front panel on which an inlet port for putting laundry therethrough is formed; and a control panel arranged on an upper portion of the front panel, wherein the control panel includes a first opening provided thereon to arrange an operation portion for operating the washing machine therein, a circuit board mounted thereon to receive a signal that is input from the operation portion, and a housing mounted thereon and having an accommodation space for accommodating a universal serial bus (USB) device for the washing machine to communicate with an external device, wherein the circuit board comprises:

a USB-type port that connects to the USB device accommodated in the accommodation space, and a guide rib formed on a bottom surface of the housing to project upward in a predetermined length to support the USB device that is received in the accommodation space, and wherein the USB device is fully accommodated in the accommodation space.

2. The washing machine as claimed in claim 1, wherein the housing further comprises:

a bottom surface that faces an inlet for entering into the accommodation space; and a plurality of side walls extending from the bottom surface to the inlet.

3. The washing machine as claimed in claim 2, wherein a slot is provided on a first side wall among the side walls to expose the USB-type port to the accommodation space.

4. The washing machine as claimed in claim 3, the housing further comprising a guide portion provided on a second side wall among the side walls to project toward the side wall that faces the second side wall so that the USB device that connects to the USB-type port is aligned with the slot when the USB device is received in the accommodation space.

5. The washing machine as claimed in claim 3, wherein a drain hole is formed on the bottom surface.

6. The washing machine as claimed in claim 3, wherein a USB-type port fixing portion for fixing the USB-type port is provided in the housing.

7. The washing machine as claimed in claim 6, the circuit board further comprising a wire configured to connect the USB-type port and the circuit board to each other.

8. The washing machine as claimed in claim 7, wherein a wire support portion for supporting the wire is provided in the housing.

9. The washing machine as claimed in claim 2, wherein a second opening for connecting to the inlet of the accommodation space is provided on the control panel.

10. The washing machine as claimed in claim 2, further comprising a cover for opening or closing the inlet of the accommodation space.

11. A washing machine comprising:

a front panel on which an inlet port for putting laundry therethrough is formed;

a control panel arranged on an upper portion of the front panel; and an upper panel, wherein the control panel includes:

a front surface portion provided with a first opening in which an operation portion for operating the washing machine is arranged, an upper surface portion extending backward from the front surface portion to be connected to the upper panel, an accommodation space for accommodating at least a part of a universal serial bus (USB) device for the washing machine to communicate with an external device, a second opening provided on the upper surface portion to enter into the accommodation space, and a USB-type port that connects to the USB device accommodated in the accommodation space, wherein the accommodation space includes a guide rib formed on a bottom surface of the accommodation space to project upward in a predetermined length to support the USB device that is received in the accommodation space, and wherein the USB device is fully accommodated in the accommodation space.

12. The washing machine as claimed in claim 11, wherein a slot is provided on one of side walls that form the accommodation space to expose the USB-type port.

13. The washing machine as claimed in claim 11, further comprising a cover for opening or closing the second opening.

* * * * *